US007576625B2

(12) United States Patent
Tsukahara

(10) Patent No.: US 7,576,625 B2
(45) Date of Patent: Aug. 18, 2009

(54) MILLIMETER-BAND SWITCHING CIRCUIT

(75) Inventor: Yoshihiro Tsukahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 144 days.

(21) Appl. No.: 11/861,396

(22) Filed: Sep. 26, 2007

(65) Prior Publication Data

US 2008/0278261 A1 Nov. 13, 2008

(30) Foreign Application Priority Data

May 8, 2007 (JP) ..... 2007-123025

(51) Int. Cl.
*H01P 1/10* (2006.01)
*H01P 5/04* (2006.01)

(52) U.S. Cl. ..... 333/103; 333/111

(58) Field of Classification Search ..... 333/101, 333/103, 104, 109, 110, 111, 112, 115, 116
See application file for complete search history.

(56) References Cited

U.S. PATENT DOCUMENTS 4,525,689 A * 6/1985 Wagner et al. ..... 333/104
4,701,724 A * 10/1987 Martin ..... 333/103
5,023,935 A * 6/1991 Vancraeynest ..... 455/80
5,363,071 A * 11/1994 Schwent et al. ..... 333/111

FOREIGN PATENT DOCUMENTS

JP 2003-224404 A 8/2003

* cited by examiner

*Primary Examiner*—Dean O Takaoka
(74) *Attorney, Agent, or Firm*—Leydig, Voit & Mayer, Ltd.

(57) ABSTRACT

A millimeter-band switching circuit easily corrects a varied off capacitance of a switching element without shifting position of the switching element. The millimeter-band switching circuit includes: a coupling line having a line length that can be changed; a first input and output terminal; a second input and output terminal; a first transmission line connected between the first input and output terminal and a first end of the coupling line; a second transmission line connected between the input and output terminal and a second end of the coupling line; a first field effect transistor (FET) connected in parallel with the first transmission line; and a second FET connected in parallel with the second transmission line and turned ON/OFF simultaneously with turning ON/OFF of the first FET.

9 Claims, 9 Drawing Sheets

MILLIMETER-BAND SWITCHING CIRCUIT

BACKGROUND OF THE INVENTION

1. Field of the Invention

The present invention relates to a millimeter-band switching circuit which operates in a millimeter-band.

2. Description of the Related Art

In a general millimeter-band switching circuit, switching elements are connected in parallel with a signal line to reduce an insertion loss. In order to ensure isolation, two or more switching elements are connected with one another through a transmission line.

A known millimeter-band single-pole single-throw (SPST) switching circuit will be described with reference to FIGS. 7 and 8. FIG. 7 is an equivalent circuit diagram showing a structure of the known millimeter-band SPST switching circuit (see, for example, JP 09-093001 A). FIG. 8 shows an insertion loss and an isolation characteristic of the known millimeter-band SPST switching circuit. The characteristics shown in FIG. 8 are obtained by simulation.

The known millimeter-band SPST switching circuit shown in FIG. 7 includes a transmission line L2 connected with a signal input and output terminal P1, a transmission line L2 connected with a signal input and output terminal P2, a transmission line L4 connected between the two transmission lines L2, a field effect transistor (FET) T whose gate is connected with a control voltage application terminal V1 through a bias resistor R, whose drain is connected with the transmission lines L2 and L4, and whose source is grounded, and a field effect transistor (FET) T whose gate is connected with the control voltage application terminal V1 through a bias resistor R, whose drain is connected with the transmission lines L2 and L4, and whose source is grounded. Note that the transmission lines expressed by the same reference symbol have the same characteristic impedance.

When an FET parameter is changed in the known millimeter-band SPST switching circuit, it is necessary to redesign a line length of the transmission line L4 located between the two FETs. FIG. 8 shows a characteristic variation example in a case of a 77 GHz-band switching circuit. In FIG. 8, Loss (dotted line) indicates an insertion loss before variation and ISO (dotted line) indicates an isolation characteristic before variation. When an off capacitance of an FET is increased by, for example, 20%, the insertion loss becomes Loss' (alternate long and short dash line) shown in FIG. 8 and the isolation becomes ISO' (alternate long and short dash line) shown therein. Therefore, there is a problem that the characteristics are shifted to a low-frequency side. In order to solve such a problem, it is necessary to shorten the line length of the transmission line L4, thereby shifting the positions of the FETs.

A known millimeter-band single-pole double-throw (SPDT) switching circuit will be described with reference to FIG. 9 (see, for example, JP 2003-179402 A). FIG. 9 is an equivalent circuit diagram showing a structure of the known millimeter-band SPDT switching circuit.

The known millimeter-band SPDT switching circuit shown in FIG. 9 includes a transmission line L2 connected with a signal input and output terminal P1, a transmission line L2 connected with a signal input and output terminal P2, an inductor LL connected between the input and output terminal P1 and a control voltage application terminal V1, an inductor LL connected between the input and output terminal P2 and a control voltage application terminal V2, a transmission line L1' connected with one of the transmission lines L2, a transmission line L1' connected with the other of the transmission lines L2, two capacitors C1, each of which is connected between corresponding one of the transmission lines L1' and a branch point, and a transmission line L5 connected between a signal input and output terminal P0 and the branch point. The switching circuit further includes a first diode D whose anode is connected with the transmission lines L2 and L1' and cathode is grounded, a second diode D whose anode is connected with transmission line L1' and a capacitor C1 and cathode is grounded, a third diode D whose anode is connected with the transmission lines L2 and L1' and cathode is grounded, and a fourth diode D whose anode is connected with transmission line L1' and a capacitor C1 and cathode is grounded.

When the diodes D are used as the switching elements, a control voltage is applied thereto through the inductor LL for cutting off an RF signal. However, it is necessary to provide the capacitor C1 for cutting off the voltage in the branch point. Therefore, there is a problem that the insertion loss is increased by the capacitor C1.

A millimeter-band switching circuit in which a coupling line is provided between two switching elements has been proposed (see, for example, JP2003-224404 A). In the conventional millimeter-band switching circuit, two structures in each of which the coupling line is provided between the switching elements are symmetrically arranged and a capacitor or an inductor is connected between the structures.

As described above, in the conventional millimeter-band SPST switching circuit, when the off capacitance of the FET (switching element) increases, there is a problem that the insertion loss and the isolation characteristic are shifted to the low-frequency side. In order to solve such a problem, it is necessary to shorten the line length of the transmission line L4 between the two FETs, which leads to another problem in that the FETs need to be shifted in position.

As described above, in the known millimeter-band SPDT switching circuit, when the diodes D are used as the switching elements, it is necessary to provide the capacitor C1 for cutting off the voltage in the branch point. Therefore, there is a problem that the insertion loss is increased by the capacitor C1.

The conventional millimeter-band switching circuit using the coupling line has a problem that the number of parts is large, thereby increasing cost.

SUMMARY OF THE INVENTION

The present invention has been made to solve one of the above-mentioned problems and an object of the present invention is to obtain a millimeter-band switching circuit capable of easily correcting a varied off capacitance of a switching element without shifting a position of the switching element.

The present invention has been made to solve another one of the above-mentioned problems and another object of the present invention is to obtain a millimeter-band switching circuit capable of suppressing an increase in insertion loss without providing a capacitor in a branch point.

Further, the present invention has been made to solve another one of the above-mentioned problems and another object of the present invention is to obtain a millimeter-band switching circuit in which the number of parts can be decreased to reduce cost.

A millimeter-band switching circuit of the present invention includes: a coupling line whose line length can be changed; a first input and output terminal; a second input and output terminal; a first transmission line connected between the first input and output terminal and a first end of the coupling line; a second transmission line connected between the second input and output terminal and a second end of the coupling line; a first switching element connected in parallel with the first transmission line; and a second switching element which is connected in parallel with the second transmission line and turned ON/OFF simultaneously with turning ON/OFF the first switching element.

According to the present invention, the millimeter-band switching circuit has an effect that the varied off capacitance of the switching element can be easily corrected without shifting the position of the switching element.

DESCRIPTION OF THE PREFERRED EMBODIMENTS

Embodiment 1

Figure 1:
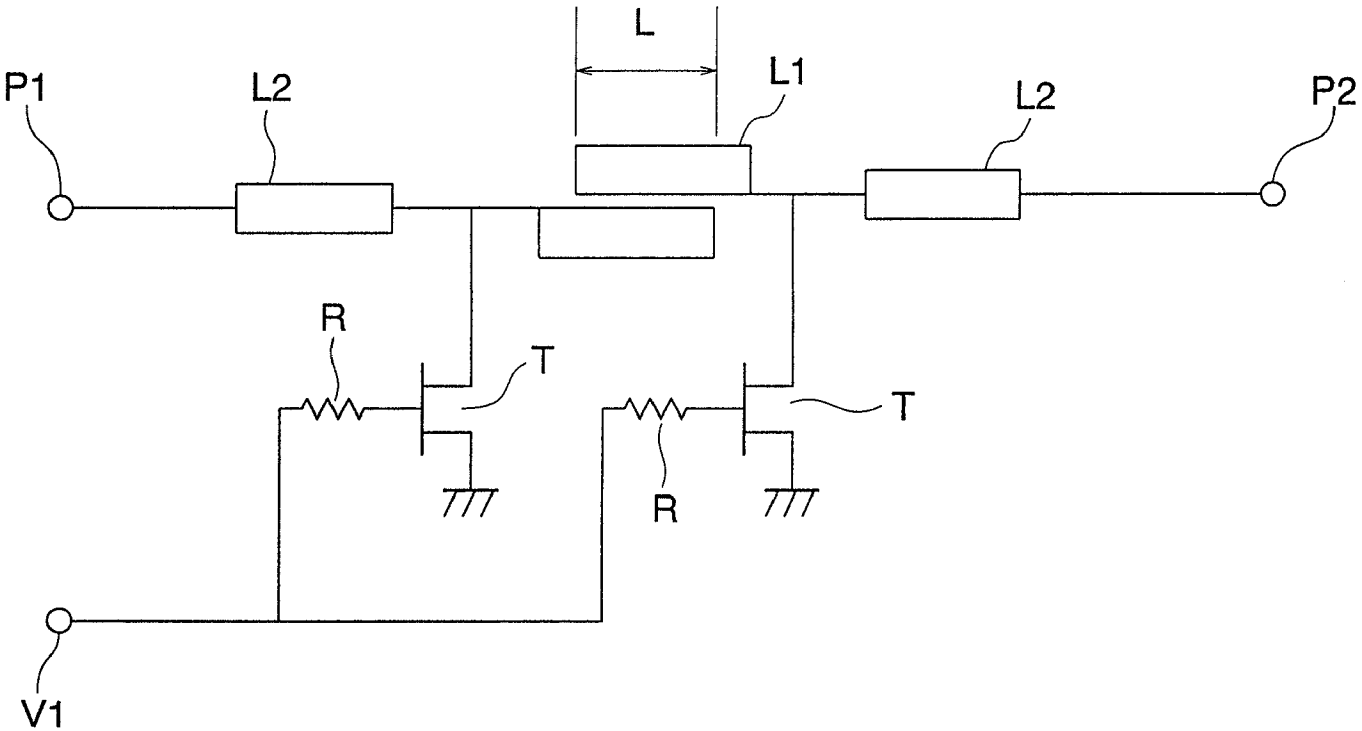
FIG. 1 is an equivalent circuit diagram showing a structure of a millimeter-band SPST switching circuit according to Embodiment 1 of the present invention.

A millimeter-band SPST switching circuit according to Embodiment 1 of the present invention will be described with reference to FIGS. 1 and 2. FIG. 1 is an equivalent circuit diagram showing a structure of the millimeter-band SPST switching circuit according to Embodiment 1 of the present invention. Hereinafter, in each of the drawings, the same reference symbols indicate the same or corresponding portions.

The millimeter-band SPST switching circuit according to Embodiment 1 of the present invention as shown in FIG. 1 includes a transmission line (first transmission line) L2 connected with a signal input and output terminal P1, a transmission line (second transmission line) L2 connected with a signal input and output terminal P2, a coupling line L1 which is connected between the two transmission lines L2 and has a length L, a field effect transistor (FET) (first switching element) T whose gate is connected with a control voltage application terminal V1 through a bias resistor R, whose drain is connected with the transmission line L2 and the coupling line L, and whose source is grounded, and a field effect transistor (FET) (second switching element) T whose gate is connected with the control voltage application terminal V1 through a bias resistor R, whose drain is connected with the coupling line L1 and the transmission line L2, and whose source is grounded.

The millimeter-band SPST switching circuit is manufactured using a monolithic microwave integrated circuit (MMIC).

Next, the operation of the millimeter-band SPST switching circuit according to Embodiment 1 of the present invention will be described with reference to the drawings. FIG. 2 shows an insertion loss and an isolation characteristic of the millimeter-band SPST switching circuit according to Embodiment 1 of the present invention.

Figure 2:
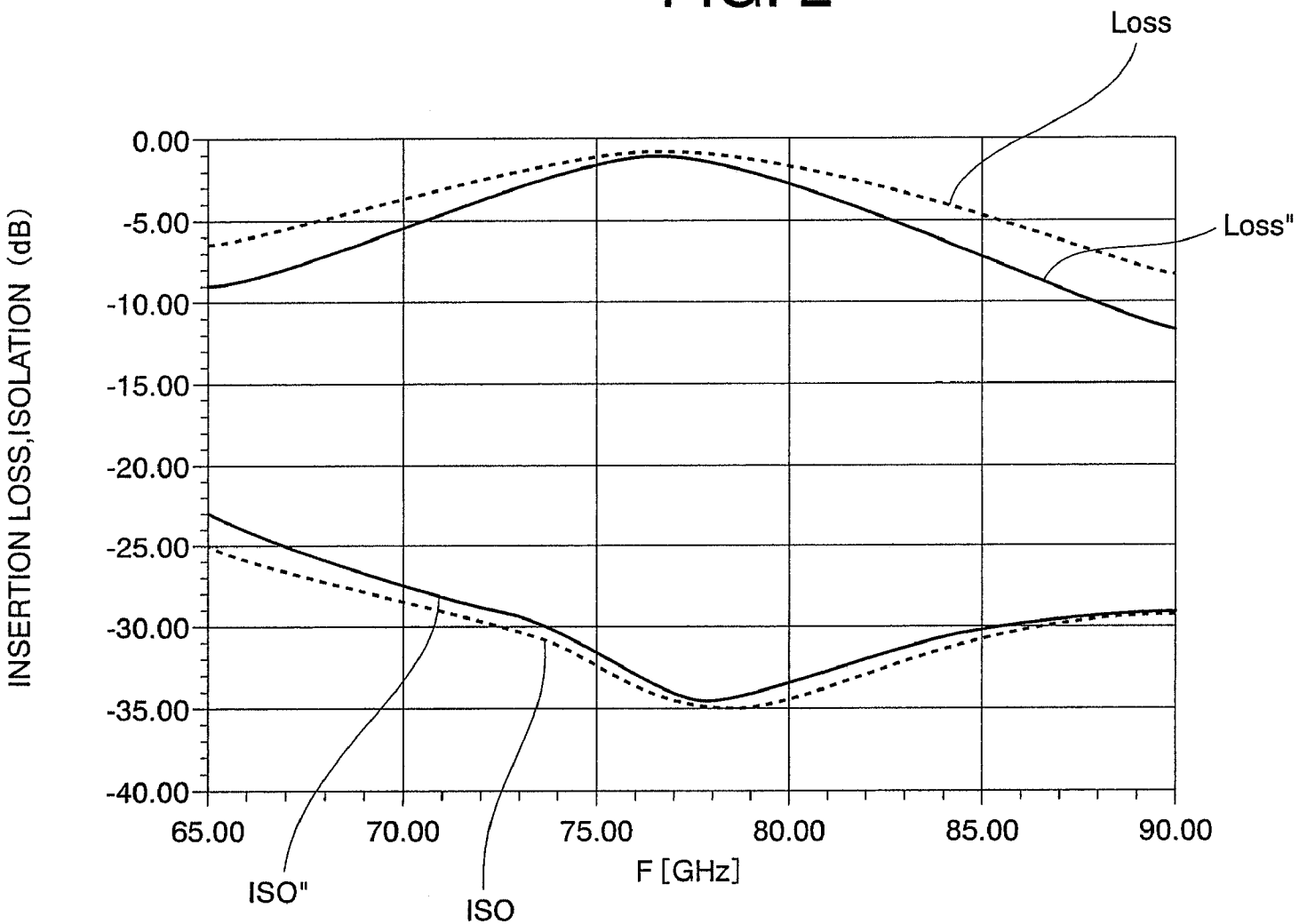
FIG. 2 shows an insertion loss and an isolation characteristic of the millimeter-band SPST switching circuit according to Embodiment 1 of the present invention.

In FIG. 2, the abscissa indicates a frequency F (GHz) and the ordinate indicates an insertion loss and an isolation (dB). In addition, Loss (dotted line) indicates an insertion loss before variation and ISO (dotted line) indicates an isolation characteristic before variation. Further, Loss" (solid line) indicates an insertion loss after variation and ISO" (solid line) indicates an isolation characteristic after variation.

When a control voltage is applied to the control voltage application terminal V1, the two FETs are simultaneously turned ON and become a high resistance. Therefore, for example, a millimeter-band signal inputted from the input and output terminal P1 is outputted from the input and output terminal P2 through the transmission line L2, the coupling lines L1, and the transmission line L2. In contrast to this, a millimeter-band signal inputted from the input and output terminal P2 is outputted from the input and output terminal P1. This corresponds to an ON state of the millimeter-band SPST switching circuit.

When the control voltage applied to the control voltage application terminal V1 becomes an OFF state, the two FETs are simultaneously turned OFF and each become lower in resistance. Therefore, for example, the millimeter-band signal inputted from the input and output terminal P1 flows from the FET (left side in FIG. 1) to a ground terminal. The millimeter-band signal inputted from the input and output terminal P2 flows from the FET (right side in FIG. 1) to the ground terminal. This corresponds to an OFF state of the millimeter-band SPST switching circuit.

As shown in FIG. 1, the coupling line L1 has two lines and a length of an overlapped portion of the two lines is the length L. When the coupling line L1 having the length L is connected between the two FETs and the length L of the coupling line L1 is changed, the frequency characteristics of the switching element can be adjusted. At the time of manufacturing, one of the two lines of the coupling line L1 is moved to change the length L of the overlapped portion of the two lines.

FIG. 2 shows an effect obtained by the change of the length L. As described in the known example, in a case where the off capacitance of an FET is increased by, for example, 20%, when the line length L of the coupling line L1 shown in FIG. 1 is shortened, the frequency characteristics can be improved. In FIG. 2, Loss" and ISO" indicate an insertion loss and an isolation, respectively, which are improved by shortening the line length L of the coupling line L1. In this case, only the line length L of the coupling line L1 is adjusted, with the result that the frequency characteristics can be adjusted without a change in FET position.

Embodiment 2

Figure 3:
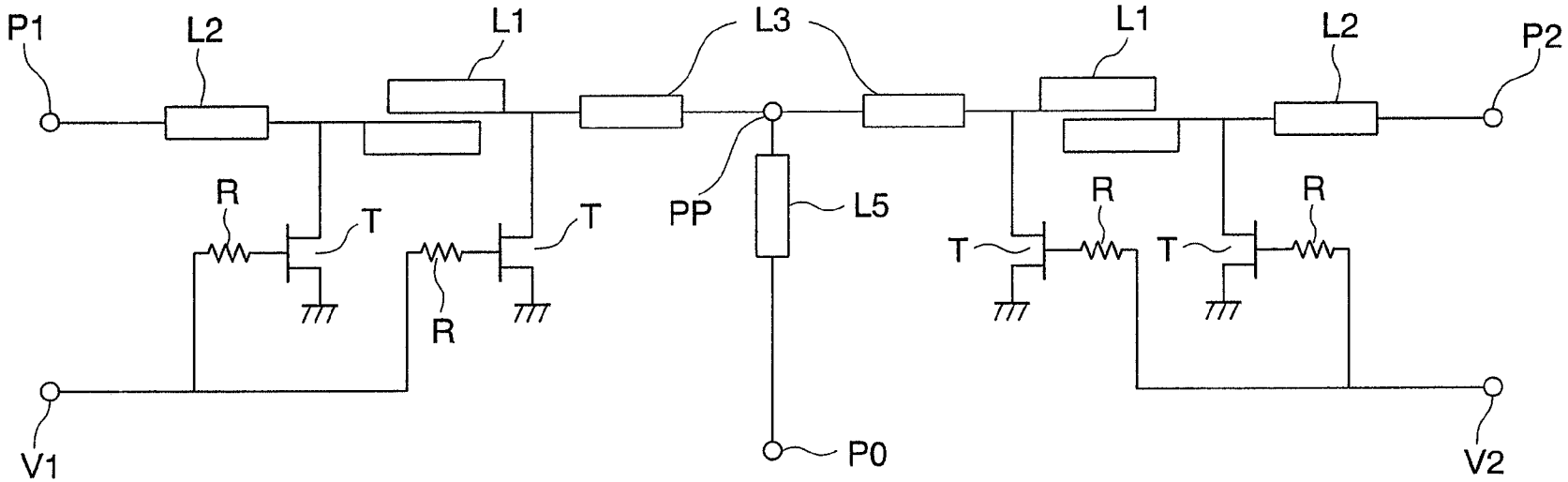
FIG. 3 is an equivalent circuit diagram showing a structure of a millimeter-band SPDT switching circuit according to Embodiment 2 of the present invention.

A millimeter-band SPDT switching circuit according to Embodiment 2 of the present invention will be described with reference to FIG. 3. FIG. 3 is an equivalent circuit diagram showing a structure of the millimeter-band SPDT switching circuit according to Embodiment 2 of the present invention.

The millimeter-band SPDT switching circuit according to Embodiment 2 of the present invention as shown in FIG. 3 includes a transmission line (first transmission line) L5 connected between a signal input and output terminal (first input and output terminal) P0 and a branch point PP, the coupling line (first coupling line) L1 which has the length L and is located on the left side, the transmission line (second transmission line) L2 connected with the signal input and output terminal (second input and output terminal) P1, a transmission line (third transmission line) L3 which is connected with the branch point PP and located on the left side, the field effect transistor (FET) (first switching element) T whose gate is connected with the control voltage application terminal V1 through the bias resistor R, whose drain is connected with the transmission line L2 and the coupling line L1, and whose source is grounded, and the field effect transistor (FET) (second switching element) T whose gate is connected with the control voltage application terminal V1 through the bias resistor R, whose drain is connected with the coupling line L1 and the transmission line L3, and whose source is grounded.

The millimeter-band SPDT switching circuit further includes a coupling line (second coupling line) L1 which has the length L and is located on the right side, a transmission line (fourth transmission line) L2 connected with the signal input and output terminal (third input and output terminal) P2, a transmission line (fifth transmission line) L3 which is connected with the branch point PP and located on the right side, a field effect transistor (FET) (third switching element) T whose gate is connected with a control voltage application terminal V2 through a bias resistor R, whose drain is connected with the transmission line L2 and the coupling line L1, and whose source is grounded, and a field effect transistor (FET) (fourth switching element) T whose gate is connected with the control voltage application terminal V2 through a bias resistor R, whose drain is connected with the coupling line L1 and the transmission line L3, and whose source is grounded.

The millimeter-band SPDT switching circuit is manufactured using a monolithic microwave integrated circuit (MMIC).

Next, the operation of the millimeter-band SPDT switching circuit according to Embodiment 2 of the present invention will be described with reference to the drawing.

For example, a control voltage is applied to the control voltage application terminal V1 to simultaneously turn ON the two FETs located on the input and output terminal P1 side. On the other hand, a control voltage applied to the control voltage application terminal V2 is set to an OFF state to simultaneously turn OFF the two FETs located on the input and output terminal P2 side. Then, a millimeter-band signal inputted from the input and output terminal P0 is outputted from the input and output terminal P1.

The control voltage is applied to the control voltage application terminal V2 to simultaneously turn ON the two FETs located on the input and output terminal P2 side. On the other hand, the control voltage applied to the control voltage application terminal V1 is set to an OFF state to simultaneously turn OFF the two FETs located on the input and output terminal P1 side. Then, the millimeter-band signal inputted from the input and output terminal P0 is outputted from the input and output terminal P2.

Even in a case of the two-branch switching circuit shown in FIG. 3, when not the FET positions but the lengths L of the two coupling lines L1 are changed, the frequency characteristics can be adjusted.

Embodiment 3

Figure 4:
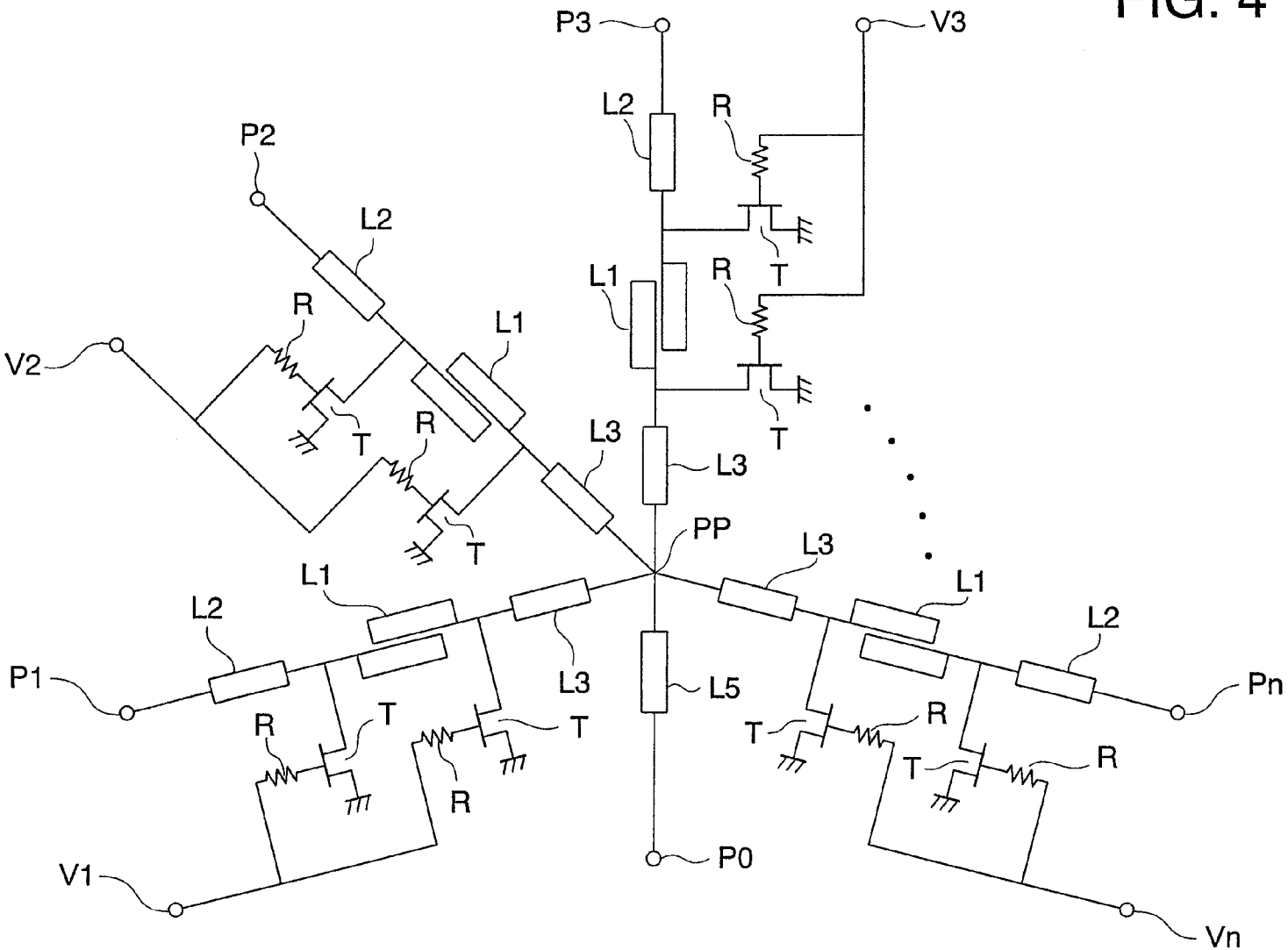
FIG. 4 is an equivalent circuit diagram showing a structure of a millimeter-band switching circuit according to Embodiment 3 of the present invention.

A millimeter-band switching circuit according to Embodiment 3 of the present invention will be described with reference to FIG. 4. FIG. 4 is an equivalent circuit diagram showing a structure of the millimeter-band switching circuit according to Embodiment 3 of the present invention.

The millimeter-band switching circuit according to Embodiment 3 of the present invention as shown in FIG. 4 includes the transmission line L5 connected between the signal input and output terminal P0 and the branch point PP, the first coupling line L1 having the length L, the transmission line L2 connected with the signal input and output terminal P1, the first transmission line L3 connected with the branch point PP, the field effect transistor (FET) T whose gate is connected with the control voltage application terminal V1 through the bias resistor R, whose drain is connected with the transmission line L2 and the coupling line L1, and whose source is grounded, and the field effect transistor (FET) T whose gate is connected with the control voltage application terminal V1 through the bias resistor R, whose drain is connected with the coupling line L1 and the transmission line L3, and whose source is grounded.

The millimeter-band switching circuit further includes the second coupling line L1 having the length L, the transmission line L2 connected with the signal input and output terminal P2, the second transmission line L3 connected with the branch point PP, the field effect transistor (FET) T whose gate is connected with the control voltage application terminal V2 through the bias resistor R, whose drain is connected with the transmission line L2 and the coupling line L1, and whose source is grounded, and the field effect transistor (FET) T whose gate is connected with the control voltage application terminal V2 through the bias resistor R, whose drain is connected with the coupling line L1 and the transmission line L3, and whose source is grounded.

The millimeter-band switching circuit further includes a third coupling line (third coupling line) L1 having the length L, a transmission line (sixth transmission line) L2 connected with a signal input and output terminal (fourth input and output terminal) P3, a third transmission line (seventh transmission line) L3 connected with the branch point PP, a field effect transistor (FET) (fifth switching element) T whose gate is connected with a control voltage application terminal V3 through a bias resistor R, whose drain is connected with the transmission line L2 and the coupling line L1, and whose source is grounded, and a field effect transistor (FET) (sixth switching element) T whose gate is connected with the control voltage application terminal V3 through a bias resistor R, whose drain is connected with the coupling line L1 and the transmission line L3, and whose source is grounded.

The millimeter-band switching circuit further includes an nth coupling line L1 having the length L, a transmission line L2 connected with a signal input and output terminal Pn, an nth transmission line L3 connected with the branch point PP, a field effect transistor (FET) T whose gate is connected with a control voltage application terminal Vn through a bias resistor R, whose drain is connected with the transmission line L2 and the coupling line L1, and whose source is grounded, and a field effect transistor (FET) T whose gate is connected with the control voltage application terminal Vn through a bias resistor R, whose drain is connected with the coupling line L1 and the transmission line L3, and whose source is grounded.

The millimeter-band switching circuit is manufactured using a monolithic microwave integrated circuit (MMIC).

Next, the operation of the millimeter-band switching circuit according to Embodiment 3 of the present invention will be described with reference to the drawing.

For example, a control voltage is applied to the control voltage application terminal V1 to simultaneously turn ON the two FETs located on the input and output terminal P1 side. On the other hand, each of control voltages applied to the other control voltage application terminals V2, V3, . . . , Vn is set to an OFF state to simultaneously turn OFF all the FETs located on the sides of the input and output terminals P2, P3, . . . , Pn. Then, a millimeter-band signal inputted from the input and output terminal P0 is outputted from the input and output terminal P1.

A control voltage is applied to the control voltage application terminal V2 to simultaneously turn ON the two FETs located on the input and output terminal P2 side. On the other hand, each of control voltages applied to the other control voltage application terminals V1, V3, . . . , Vn is set to an OFF state to simultaneously turn OFF all the FETs located on the sides of the input and output terminals P1, P3, . . . , Pn. Then, the millimeter-band signal inputted from the input and output terminal P0 is outputted from the input and output terminal P2.

A control voltage is applied to the control voltage application terminal V3 to simultaneously turn ON the two FETs located on the input and output terminal P3 side. On the other hand, each of control voltages applied to the other control voltage application terminals V1, V2, . . . , Vn is set to an OFF state to simultaneously turn OFF all the FETs located on the sides of the input and output terminals P1, P2, . . . , Pn. Then, the millimeter-band signal inputted from the input and output terminal P0 is outputted from the input and output terminal P3.

A control voltage is applied to the control voltage application terminal Vn to simultaneously turn ON the two FETs located on the input and output terminal Pn side. On the other hand, each of control voltages applied to the other control voltage application terminals V1, V2, V3, . . . , Vn is set to an OFF state to simultaneously turn OFF all the FETs located on the sides of the input and output terminals P1, P2, P3, . . . , Pn. Then, the millimeter-band signal inputted from the input and output terminal P0 is outputted from the input and output terminal Pn.

Even in the case of the n-branch switching circuit shown in FIG. 4, an effect of the frequency characteristic adjustment is identical to that obtained in each of the embodiments.

Embodiment 4

Figure 5:
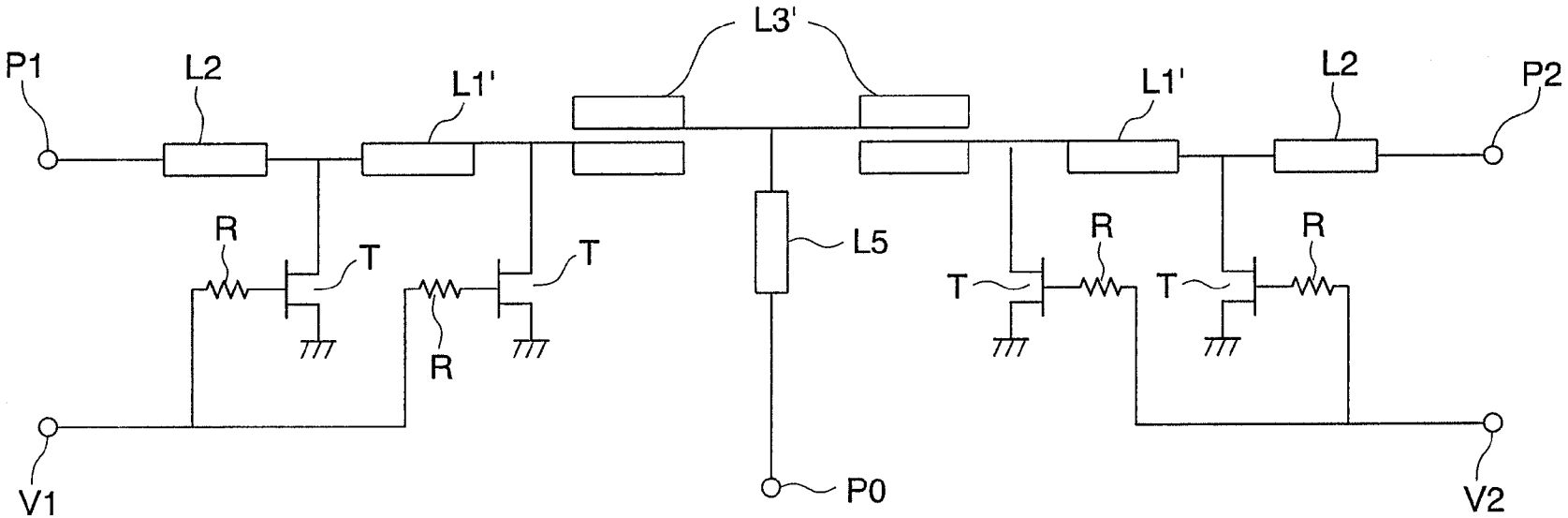
FIG. 5 is an equivalent circuit diagram showing a structure of a millimeter-band SPDT switching circuit according to Embodiment 4 of the present invention.

A millimeter-band SPDT switching circuit according to Embodiment 4 of the present invention will be described with reference to FIG. 5. FIG. 5 is an equivalent circuit diagram showing a structure of the millimeter-band SPDT switching circuit according to Embodiment 4 of the present invention.

The millimeter-band SPDT switching circuit according to Embodiment 4 of the present invention as shown in FIG. 5 includes the transmission line L5 connected between the signal input and output terminal P0 and the branch point PP, a coupling line L3' which has the length L, is connected with the branch point PP, and is located on the left side, the transmission line L2 connected with the signal input and output terminal P1, a transmission line L1' which is connected between the transmission line L2 and the coupling line L3' and located on the left side, the switching element T such as the field effect transistor (FET) whose gate is connected with the control voltage application terminal V1 through the bias resistor R, whose drain is connected with the transmission lines L2 and L1', and whose source is grounded, and the switching element T such as the field effect transistor (FET) whose gate is connected with the control voltage application terminal V1 through the bias resistor R, whose drain is connected with the transmission line L1' and the coupling line L3', and whose source is grounded.

The millimeter-band SPDT switching circuit further includes a coupling line L3' which has the length L, is connected with the branch point PP, and is located on the right side, a transmission line L2 connected with the signal input and output terminal P2, a transmission line L1' which is connected between the transmission line L2 and the coupling line L3' and located on the right side, the switching element T such as the field effect transistor (FET) whose gate is connected with the control voltage application terminal V2 through the bias resistor R, whose drain is connected with the transmission lines L2 and L1', and whose source is grounded, and the switching element T such as the field effect transistor (FET) whose gate is connected with the control voltage application terminal V2 through the bias resistor R, whose drain is connected with the transmission line L1' and the coupling line L3', and whose source is grounded.

The millimeter-band SPDT switching circuit is manufactured using a monolithic microwave integrated circuit (MMIC).

Next, the operation of the millimeter-band SPDT switching circuit according to Embodiment 4 of the present invention will be described with reference to the drawing.

For example, a control voltage is applied to the control voltage application terminal V1 to simultaneously turn ON the two FETs located on the input and output terminal P1 side. On the other hand, a control voltage applied to the control voltage application terminal V2 is set to an OFF state to simultaneously turn OFF the two FETs located on the input and output terminal P2 side. Then, a millimeter-band signal inputted from the input and output terminal P0 is outputted from the input and output terminal P1.

The control voltage is applied to the control voltage application terminal V2 to simultaneously turn ON the two FETs located on the input and output terminal P2 side. On the other hand, the control voltage applied to the control voltage application terminal V1 is set to an OFF state to simultaneously turn OFF the two FETs located on the input and output terminal P1 side. Then, the millimeter-band signal inputted from the input and output terminal P0 is outputted from the input and output terminal P2.

FIG. 5 shows a modified example of the switching circuit according to Embodiment 2 as shown in FIG. 3. Even in a case where the coupling lines L3' are used as the transmission lines connected with the branch point for the two-branch switching circuit, when the lengths L of the coupling lines L3' are changed according to variations in FET characteristics, there is the same effect of frequency characteristic adjustment.

Embodiment 5

Figure 6:
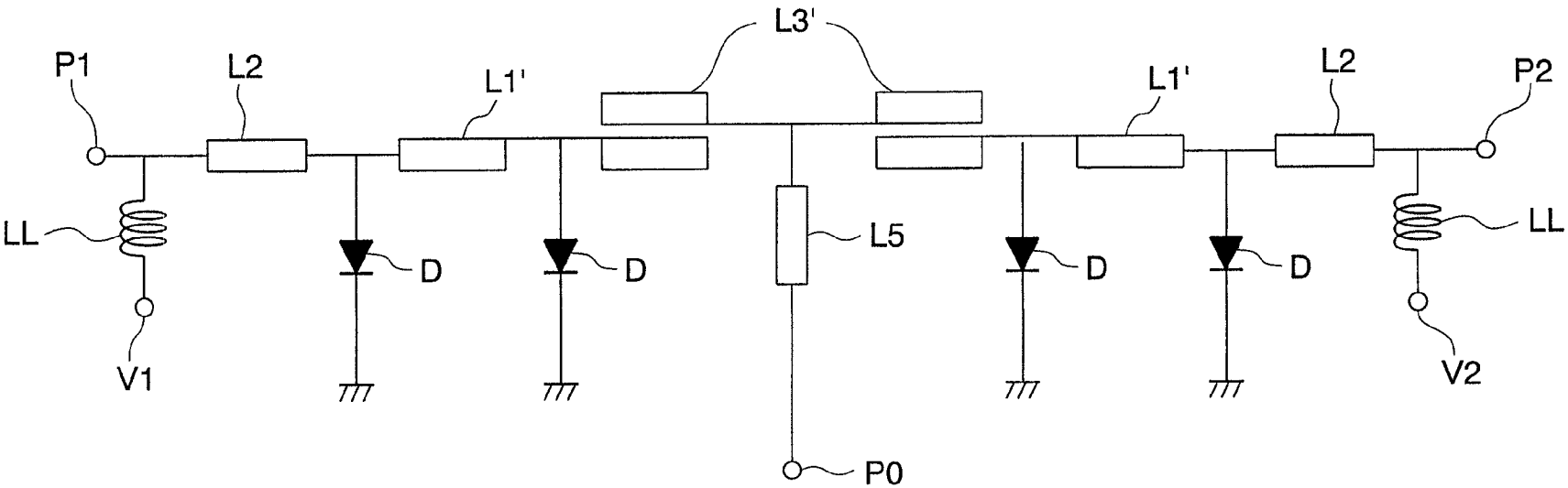
FIG. 6 is an equivalent circuit diagram showing a structure of a millimeter-band SPDT switching circuit according to Embodiment 5 of the present invention.
Figure 7:
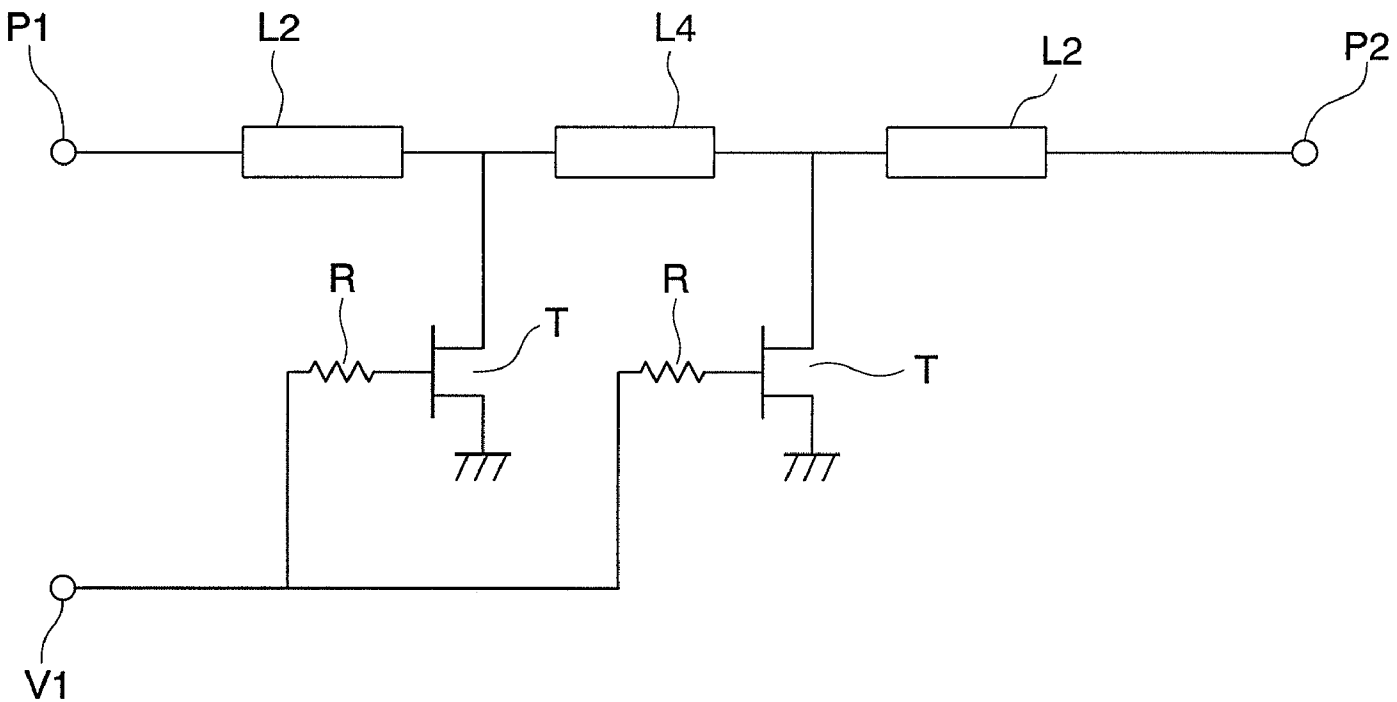
FIG. 7 PRIOR ART
FIG. 7 is an equivalent circuit diagram showing a structure of a known millimeter-band SPST switching circuit.
Figure 8:
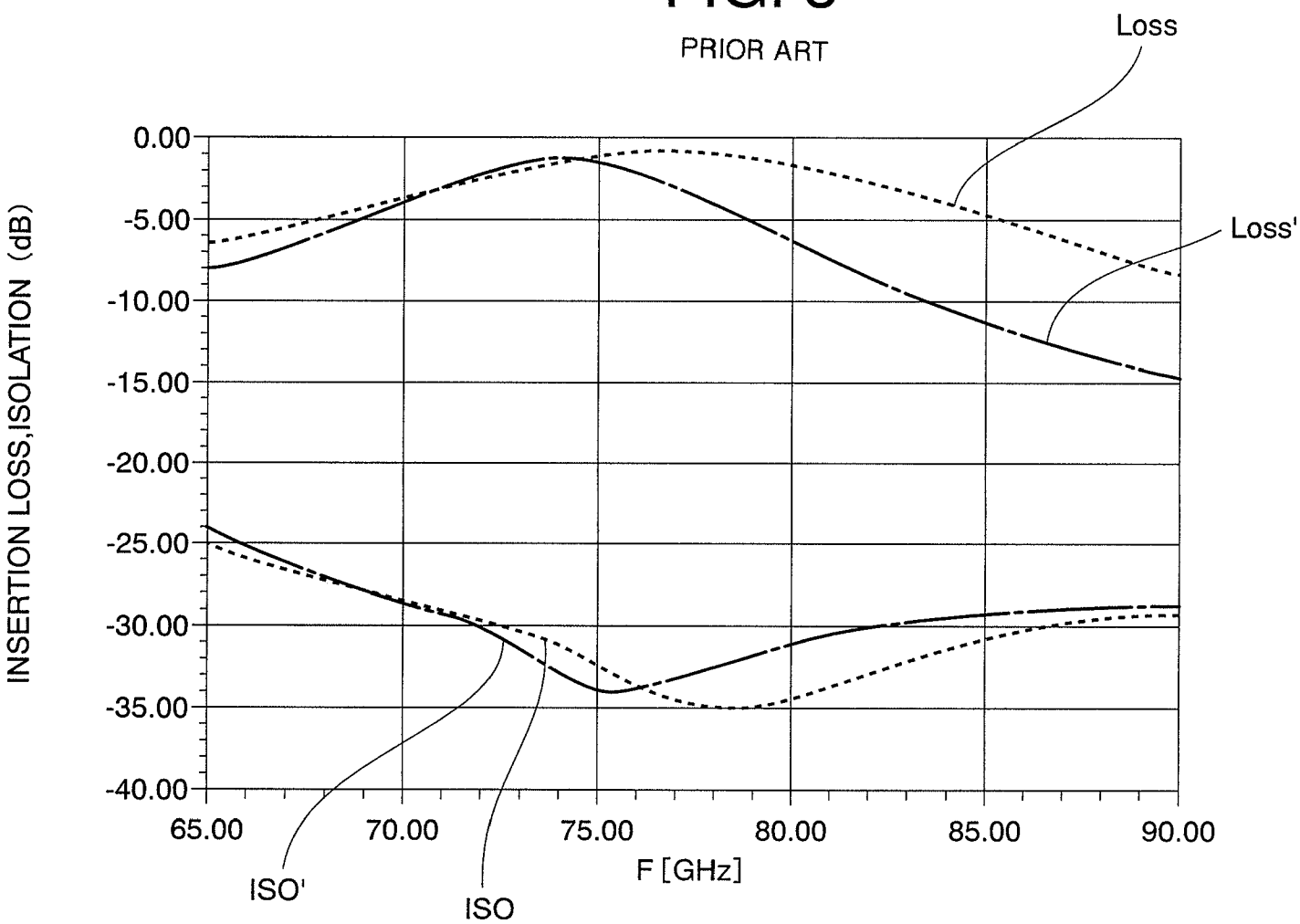
FIG. 8 PRIOR ART
FIG. 8 shows an insertion loss and an isolation characteristic of the known millimeter-band SPST switching circuit.
Figure 9:
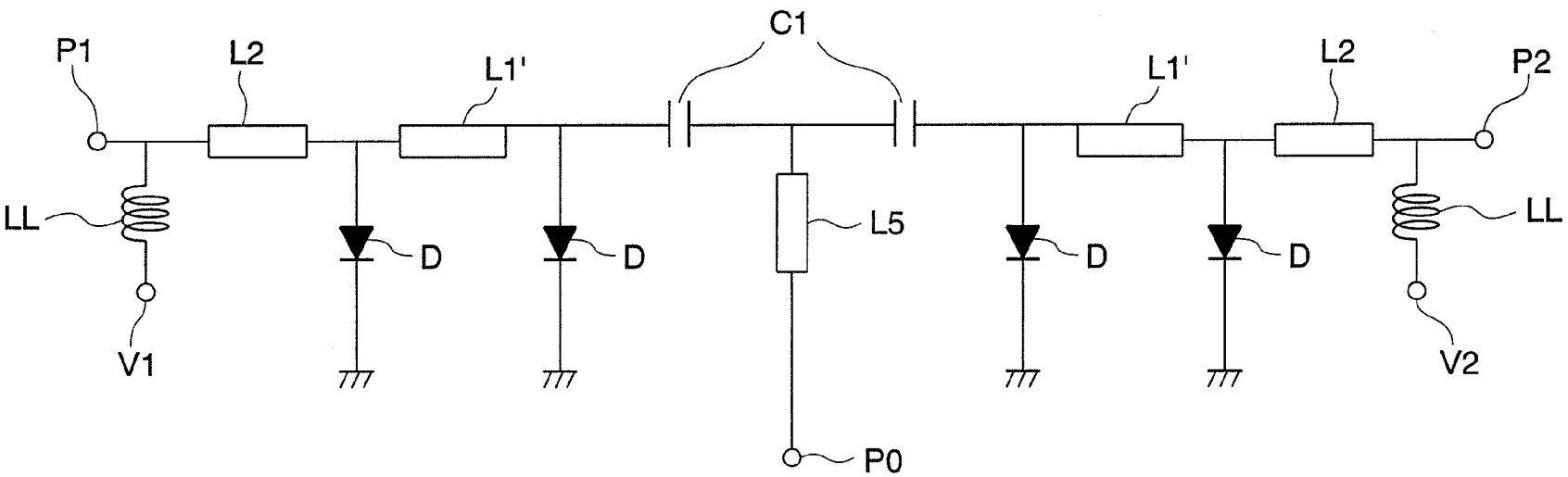
FIG. 9 PRIOR ART
FIG. 9 is an equivalent circuit diagram showing a structure of a known millimeter-band SPDT switching circuit.

A millimeter-band SPDT switching circuit according to Embodiment 5 of the present invention will be described with reference to FIG. 6. FIG. 6 is an equivalent circuit diagram showing a structure of the millimeter-band SPDT switching circuit according to Embodiment 5 of the present invention.

The millimeter-band SPDT switching circuit according to Embodiment 5 of the present invention as shown in FIG. 6 includes the transmission line L5 connected between the signal input and output terminal P0 and the branch point, the coupling line L3' which has the length L, is connected with the branch point, and is located on the left side, the transmission line L2 connected with the signal input and output terminal P1, an inductor LL connected between the input and output terminal P1 and the control voltage application terminal V1, the transmission line L1' which is connected between the transmission line L2 and the coupling line L3' and located on the left side, a first diode (first switching element) D whose anode is connected with the transmission lines L2 and L1' and cathode is grounded, and a second diode (second switching element) D whose anode is connected with transmission line L1' and the coupling line L3' and cathode is grounded.

The millimeter-band SPDT switching circuit further includes the coupling line L3' which has the length L, is connected with the branch point, and is located on the right side, the transmission line L2 connected with the signal input and output terminal P2, an inductor LL connected between the input and output terminal P2 and the control voltage application terminal V2, the transmission line L1' which is connected between the transmission line L2 and the coupling line L3' and located on the right side, a third diode (third switching element) D whose anode is connected with the transmission lines L2 and L1' and cathode is grounded, and a fourth diode (fourth switching element) D whose anode is connected with transmission line L1' and the coupling line L3' and cathode is grounded.

The millimeter-band SPDT switching circuit is manufactured using a monolithic microwave integrated circuit (MMIC).

Next, the operation of the millimeter-band SPDT switching circuit according to Embodiment 5 of the present invention will be described with reference to the drawing.

For example, a control voltage is applied to the control voltage application terminal V1 to simultaneously turn ON the two diodes D located on the input and output terminal P1 side. On the other hand, a control voltage applied to the control voltage application terminal V2 is set to an OFF state to simultaneously turn OFF the two diodes D located on the input and output terminal P2 side. Then, a millimeter-band signal inputted from the input and output terminal P0 is outputted from the input and output terminal P1.

The control voltage is applied to the control voltage application terminal V2 to simultaneously turn ON the two diodes D located on the input and output terminal P2 side. On the other hand, the control voltage applied to the control voltage application terminal V1 is set to an OFF state to simultaneously turn OFF the two diodes D located on the input and output terminal P1 side. Then, the millimeter-band signal inputted from the input and output terminal P0 is outputted from the input and output terminal P2.

FIG. 6 shows the two-branch switching circuit using the diodes D instead of the FETs of the millimeter-band SPDT switching circuit shown in FIG. 5. An effect obtained in Embodiment 5 is identical to that obtained in Embodiment 4. That is, when not the positions of the diodes D but the lengths L of the coupling lines L3' are changed, the frequency characteristics can be adjusted. It is unnecessary to provide capacitors in the branch point, so an increase in insertion loss which is caused by the capacitors can be suppressed.

What is claimed is:

1. A millimeter-band switching circuit, comprising:
- a coupling line having a line length that can be changed;
- a first input and output terminal;
- a second input and output terminal;
- a first transmission line connected between the first input and output terminal and a first end of the coupling line;
- a second transmission line connected between the second input and output terminal and a second end of the coupling line;
- a first switching element connected in parallel with the first transmission line; and
- a second switching element connected in parallel with the second transmission line and turned ON/OFF simultaneously with turning ON/OFF of the first switching element.

2. A millimeter-band switching circuit, comprising:
- a first input and output terminal;
- a second input and output terminal;
- a branch point;
- a first transmission line connected between the first input and output terminal and the branch point;
- a first coupling line having a line length that can be changed;
- a second transmission line connected between the second input and output terminal and a first end of the first coupling line;
- a third transmission line connected between the branch point and a second end of the first coupling line;
- a first switching element connected in parallel with the second transmission line;
- a second switching element connected in parallel with the third transmission line and turned ON/OFF simultaneously with turning ON/OFF of the first switching element;
- a second coupling line having a line length that can be changed;
- a third input and output terminal;
- a fourth transmission line connected between the third input and output terminal and a first end of the second coupling line;
- a fifth transmission line connected between the branch point and a second end of the second coupling line;
- a third switching element connected in parallel with the fourth transmission line; and
- a fourth switching element connected in parallel with the fifth transmission line and turned ON/OFF simultaneously with turning ON/OFF of the third switching element.

3. The millimeter-band switching circuit according to claim 2, further comprising:
- a third coupling line having a line length that can be changed;
- a fourth input and output terminal;
- a sixth transmission line connected between the fourth input and output terminal and a first end of the third coupling line;
- a seventh transmission line connected between the branch point and a second end of the third coupling line;
- a fifth switching element connected in parallel with the sixth transmission line; and
- a sixth switching element connected in parallel with the seventh transmission line and turned ON/OFF simultaneously with turning ON/OFF of the fifth switching element.

4. The millimeter-band switching circuit according to claim 2, wherein:
- the first coupling line and the third transmission line are interchanged; and
- the second coupling line and the fifth transmission line are interchanged.

5. The millimeter-band switching circuit according to claim 1, wherein each of the first switching element and the second switching element comprises a field effect transistor.

6. The millimeter-band switching circuit according to claim 4, wherein each of the first switching element, the second switching element, the third switching element, and the fourth switching element comprises a diode.

7. The millimeter-band switching circuit according to claim 2, wherein each of the first switching element, the second switching element, the third switching element, and the fourth switching element comprises a field effect transistor.

8. The millimeter-band switching circuit according to claim 3, wherein each of the first switching element, the second switching element, the third switching element, the fourth switching element, the fifth switching element, and the sixth switching element comprises a field effect transistor.

9. The millimeter-band switching circuit according to claim 4, wherein each of the first switching element the second switching element, the third switching element, and the fourth switching element comprises a field effect transistor.

* * * * *